US008713721B2

(12) United States Patent
Zhang et al.

(10) Patent No.: US 8,713,721 B2
(45) Date of Patent: May 6, 2014

(54) URINAL INSTALLED WITH A CONDUCTIVE SENSOR

(75) Inventors: Xiaojing Zhang, Shanghai (CN); Lin Wan, Shanghai (CN); Feng Lin, Shanghai (CN)

(73) Assignee: Shanghai Kohler Electronics, Ltd., Shanghai (CN)

( * ) Notice: Subject to any disclaimer, the term of this patent is extended or adjusted under 35 U.S.C. 154(b) by 759 days.

(21) Appl. No.: 12/915,526

(22) Filed: Oct. 29, 2010

(65) Prior Publication Data

US 2011/0252551 A1 Oct. 20, 2011

(30) Foreign Application Priority Data

Oct. 30, 2009 (CN) ..... 2009 1 0197970

(51) Int. Cl.
*E03D 13/00* (2006.01)

(52) U.S. Cl.
USPC ..... 4/305

(58) Field of Classification Search
USPC ..... 4/302, 305
See application file for complete search history.

(56) References Cited

U.S. PATENT DOCUMENTS 3,751,736 A * 8/1973 Egli ..... 4/305
8,281,422 B2 * 10/2012 Chen et al. ..... 4/305

* cited by examiner

*Primary Examiner* — Huyen Le
(74) *Attorney, Agent, or Firm* — Foley & Lardner LLP

(57) ABSTRACT

The present invention discloses a conductive sensor and a urinal having conductive sensor. Said conductive sensor is installed in the sewer pipe of the urinal or toilet, which comprises an insulating body and a detecting electrode used for detecting the electric conductivity of the liquid in the sewer pipe. Said conductive sensor also comprises a self-cleaning device used for cleaning the end of the detecting electrode. Said self-cleaning device comprises a housing, a piston unit and a brush head unit. A water inlet pipe connected with the tap water pipe and a water outlet pipe connected with the sewer pipe are installed to said housing. Said brush head unit comprises a brush head used for cleaning the end of the detecting electrode. Thus, the detected result of conductive sensor and the urinal having conductive sensor are more reliable and the device is easy to be maintained.

16 Claims, 4 Drawing Sheets

URINAL INSTALLED WITH A CONDUCTIVE SENSOR

TECHNICAL FIELD

The present invention relates to a conductive sensor and a urinal having the conductive sensor.

TECHNICAL BACKGROUND

In prior art, sensors for detecting users, such as infrared sensors, are installed in urinal or toilet to traditionally realize automatic flushing after the users finish the using of urinal or toilet. However, the infrared sensors have many defects:

On one hand, most of the traditional infrared sensors adopt the active sensing mode, namely the infrared emitting device emits the infrared rays having limited wave length; the infrared receiving device receives the reflected infrared rays after the infrared rays are reflected by human body, and then the judge of automatic sensing is realized based on the intensity of the reflected signal. However, the automatic sensing is difficult to be performed when the infrared ray irradiates on some objects (such as black clothing, hair so on) that having low reflectivity. After the infrared light emitted by the infrared emitting device is reflected by the subjects having low reflectivity, few reflected infrared is received by the infrared receiving device. The sensor could not detect the existence of the target objects having low reflectivity because the reflected signal is too weak. Thus, malfunction of the infrared sensor will be caused.

On the other hand, after the traditional infrared sensor detects that the user has used urinal or toilet for a period of time, and then detects that the user leaves, the toiler or urinal will be cleaned with a certain mount of water. However, the automatic flushing system, which flushes based on whether the user is detected in the detected area or not, will flush with a certain mount of water regardless whether the user uses the urinal or toilet and regardless of the volume of the urine. This way, lots of water is wasted.

In prior art, conductive sensor is used to detect the change of the conductivity of the liquid in the trap of the urinal. As the urine's conductivity is different from that of the water, if the urine flows into the trap and the electrode of the conductive senor touches the urine, the detected conductivity will change. When it is detected that the urine flows into the trap, the urinal will be controlled to flush. The conductive senor overcomes the defects of using sensing window of the traditional infrared sensor, as well as overcomes the malfunction to the things having low reflectivity in the traditional infrared senor or other defects.

However the surface of the electrode of the conductive senor will be covered by the deposited ordure because the conductive sensor touches the urine for a long time. Thus, the detecting performance of the conductive sensor will be affected and the sensing malfunction will be caused.

Therefore, it is necessary to improve the conductive sensor.

SUMMARY OF THE INVENTION

The first object of the present invention is to provide a conductive sensor having reliable detection.

The second object of the present invention is to provide a urinal installed with a conductive sensor having reliable detection.

Based on above-mentioned first object, the present invention provides the following technical solutions: a conductive sensor is installed in the sewer pipe of urinal or toilet, which comprises an insulating body and a detecting electrode installed at the insulating body to detect the electric conductivity of the liquid in the sewer pipe. Said conductive sensor also comprises a self-cleaning device used for cleaning the end of the detecting electrode; Said self-cleaning device comprises a housing, a piston unit mounted inside the housing and a brush head unit connected with the piston unit. A water inlet pipe connected with the tap water pipe and a water outlet pipe connected with the sewer pipe are mounted to said housing. Said brush head unit comprises a brush head used for cleaning the end of the detecting electrode.

Further, said housing comprises a first housing, a second housing and a third housing; said water inlet pipe is set to the first housing and said water outlet pipe is set to the second housing.

Further, said piston unit comprises a first piston, a second piston, a spring set on the second piston, and a cylinder body accommodating the second piston and the spring; said first piston comprises the first piston top and the first piston rod, and said second piston comprises the second piston top and the second piston rod.

Further, said first piston is mounted inside the holding chamber formed by the first housing and the second housing.

Further, after said second piston and the spring are accommodated to the cylinder body, the cylinder body is mounted inside the holding chamber formed by the second housing and the third housing. The first piston rod of the first piston presses at the second piston top of the second piston.

Further, said brush head unit also comprises a fixing element used for fixing the brush head; said fixing element is connected with the end of the second piston rod of the second piston.

Further, said piston unit comprises the piston and the spring set on the piston; said piston comprises the piston top and the piston rod; the brush head of said brush head unit is fixed at the end of the piston rod.

Further, the cleaning strips are mounted on said brush head.

Based on above-mentioned second object, the present invention provides the following technical solutions: a urinal having the conductive sensor comprises a urinal body, a sewer pipe used for connecting the urinal body and the sewage channel, a conductive sensor installed in the sewer pipe, and a controller electronically connected with the conductive sensor; in which said sewer pipe comprises an inlet, an outlet and a trap; said inlet is connected with the urinal body and the outlet is connected with the sewage channel; said conductive sensor comprises an insulating body and a detecting electrode mounted at said insulating body to detect the electric conductivity of the liquid in the trap; said conductive sensor also comprises a self-cleaning device controlled by the controller to clean the head of the detecting electrode. Said self-cleaning device comprises a housing, a piston unit mounted inside said housing, and a brush head unit connected with the piston unit. A water inlet pipe connected with the tap water pipe and a water outlet pipe connected with the sewer pipe are mounted to said housing. Said brush head unit comprises a brush head used for cleaning the end of the detecting electrode.

Further, said housing further comprises a first housing, a second housing and a third housing; said water inlet pipe is set to the first housing, and said water outlet pipe is set to the second housing.

Further, said piston unit comprises a first piston, a second piston, a spring set on the second piston, and a cylinder body accommodating the second piston and the spring; said first piston comprises the first piston top and the first piston rod, and said second piston comprises the second piston top and the second piston rod.

Further, said first piston is set inside the holding chamber formed by the first housing and the second housing.

Further, after said second piston and the spring are accommodated to the cylinder body, the cylinder body is mounted inside the holding chamber formed by the second housing and the third housing. The first piston rod of the first piston presses at the second piston top of the second piston.

Further, said brush head unit comprises a fixing element connected with the end of the second piston rod of the second piston.

Further, said piston unit comprises the piston and the spring set on the piston; said piston comprises the piston top and the piston rod; the brush head of said brush head unit is fixed on the end of the piston rod.

Further, the cleaning strips are mounted on said brush head.

Compared with the prior art, the conductive sensor and the urinal having the conductive sensor of the present invention have cleaning device to clean the detecting electrode, which overcomes the sensing malfunction of traditional conductive sensor caused by the deposited ordure. The water pressure drives the piston and the piston drives the brush head to move to clean the detecting electrode, which brings better result. Therefore, the detected result of conductive sensor and the urinal having conductive sensor are more reliable and the device is easy to be maintained.

DESCRIPTION OF THE EMBODIMENTS

The embodiments of the present invention will be clearly described referring to the attached drawings, the same structure or same function is marked with the same numbers. It is understood that the attached drawings are just for the description of the embodiments of the present invention, not the limitation to the present invention. Besides, the attached drawings needn't to be drawn in proportion.

Figure 1:
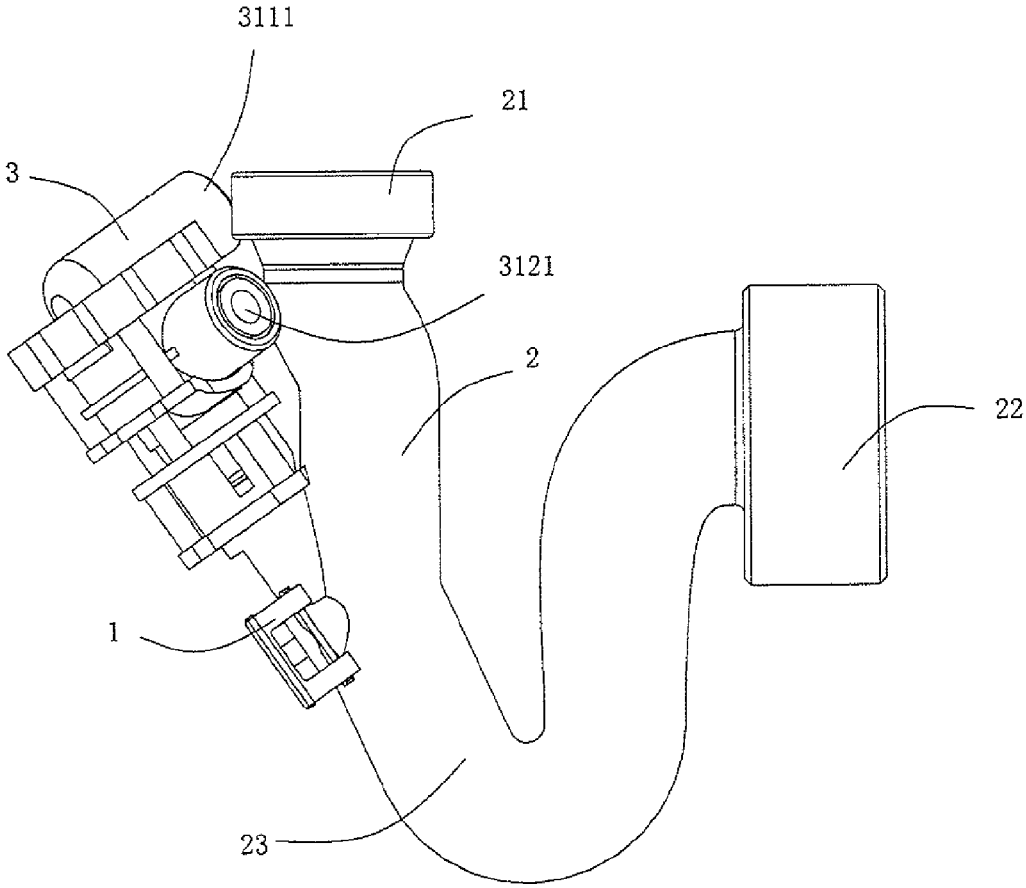
FIG. 1 is the sketch map showing how the inductive sensor is installed in the sewer pipe of the toilet or urinal.
Figure 2:
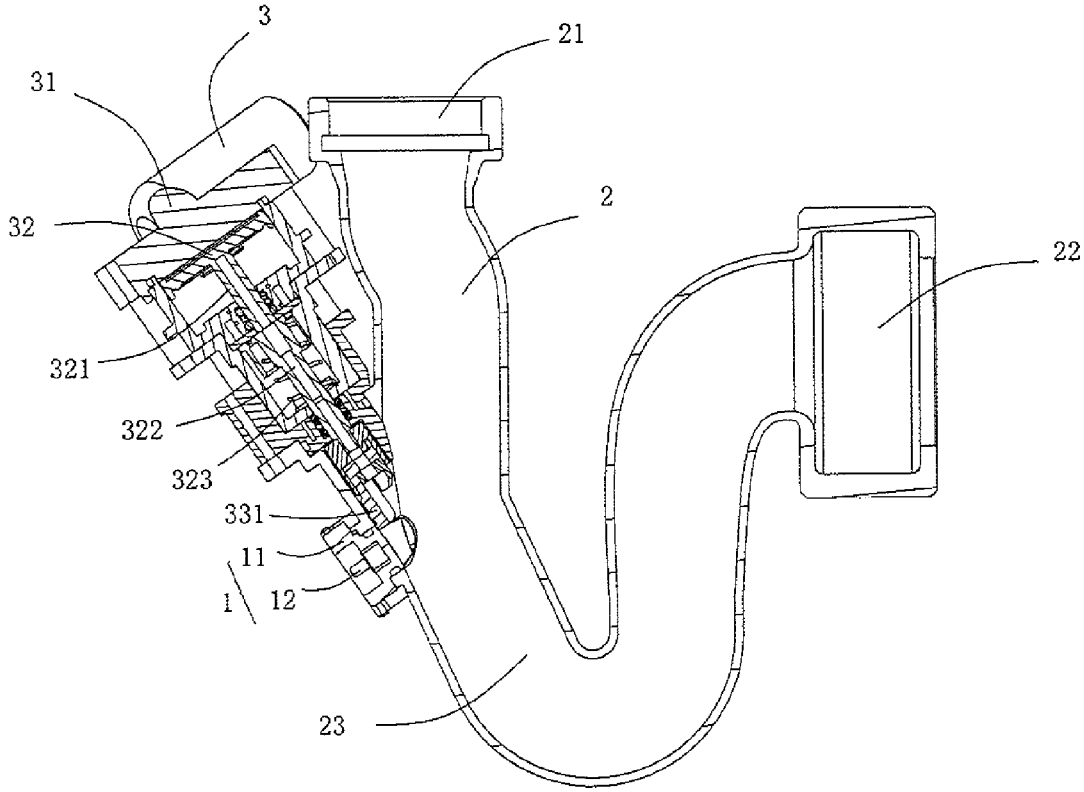
FIG. 2 is the profile view along the center line of the sewer pipe.

As shown from FIG. 1 to FIG. 2, the conductive sensor 1 of the present invention is mounted in sanitary equipments (not shown on the drawings), such as toilet or urinal, etc., and it comprises a insulating body 11, a detecting electrode 12 mounted to the insulating body 11 for detecting electric conductivity of the liquid in toilet or urinal. The conductive sensor 1 is usually mounted at the sewer pipe 2 in order to detect the change of electric conductivity of the liquid in toilet or urinal conveniently. The number of said detecting electrode 12 is at least two.

Said sewer pipe 2 comprises an inlet 21, an outlet 22 and a trap 23. Said conductive sensor 1 is usually mounted near the trap 23 of said sewer pipe 2 or at the position of trap 23, and it is better that the end of the detecting electrode 12 is immersed into the liquid in the trap 23.

Figure 3:
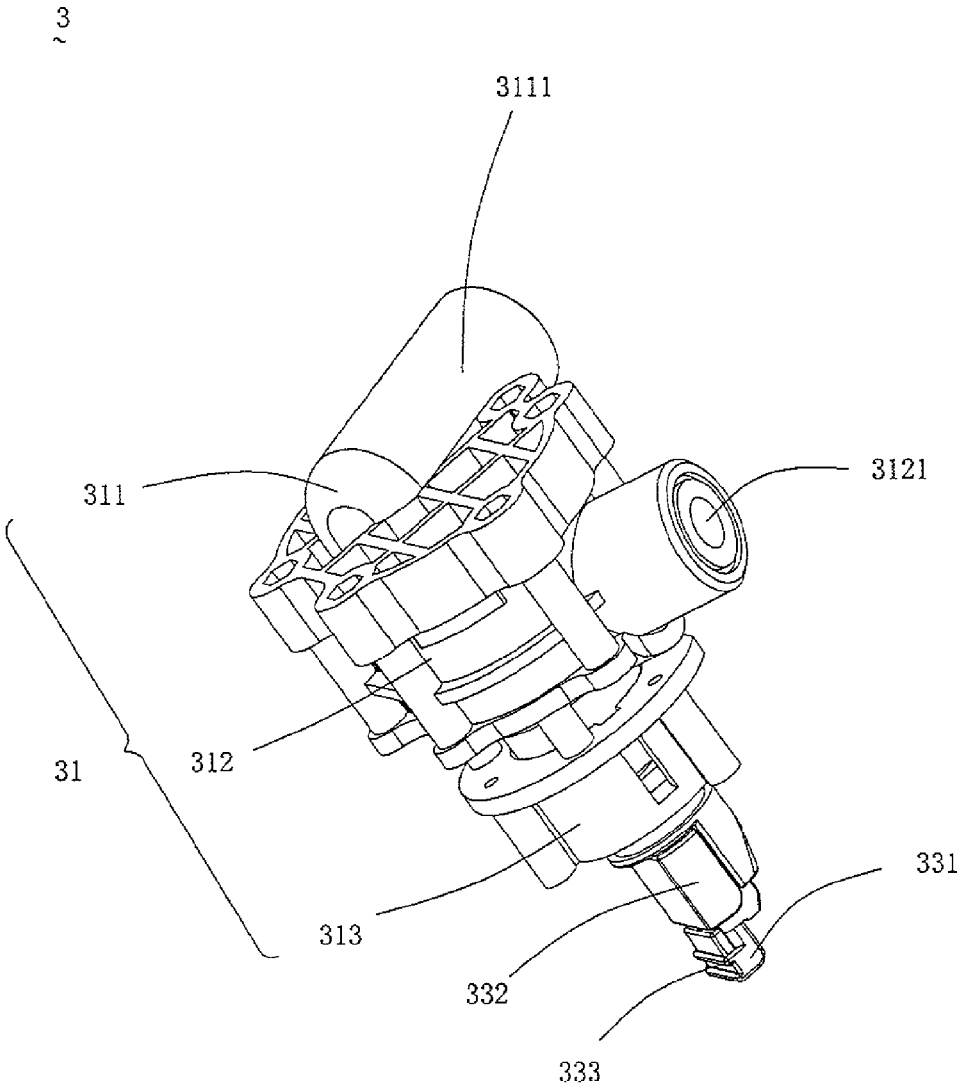
FIG. 3 is the three-dimensional sketch map of the self-cleaning device of the conductive sensor in the present invention.
Figure 4:
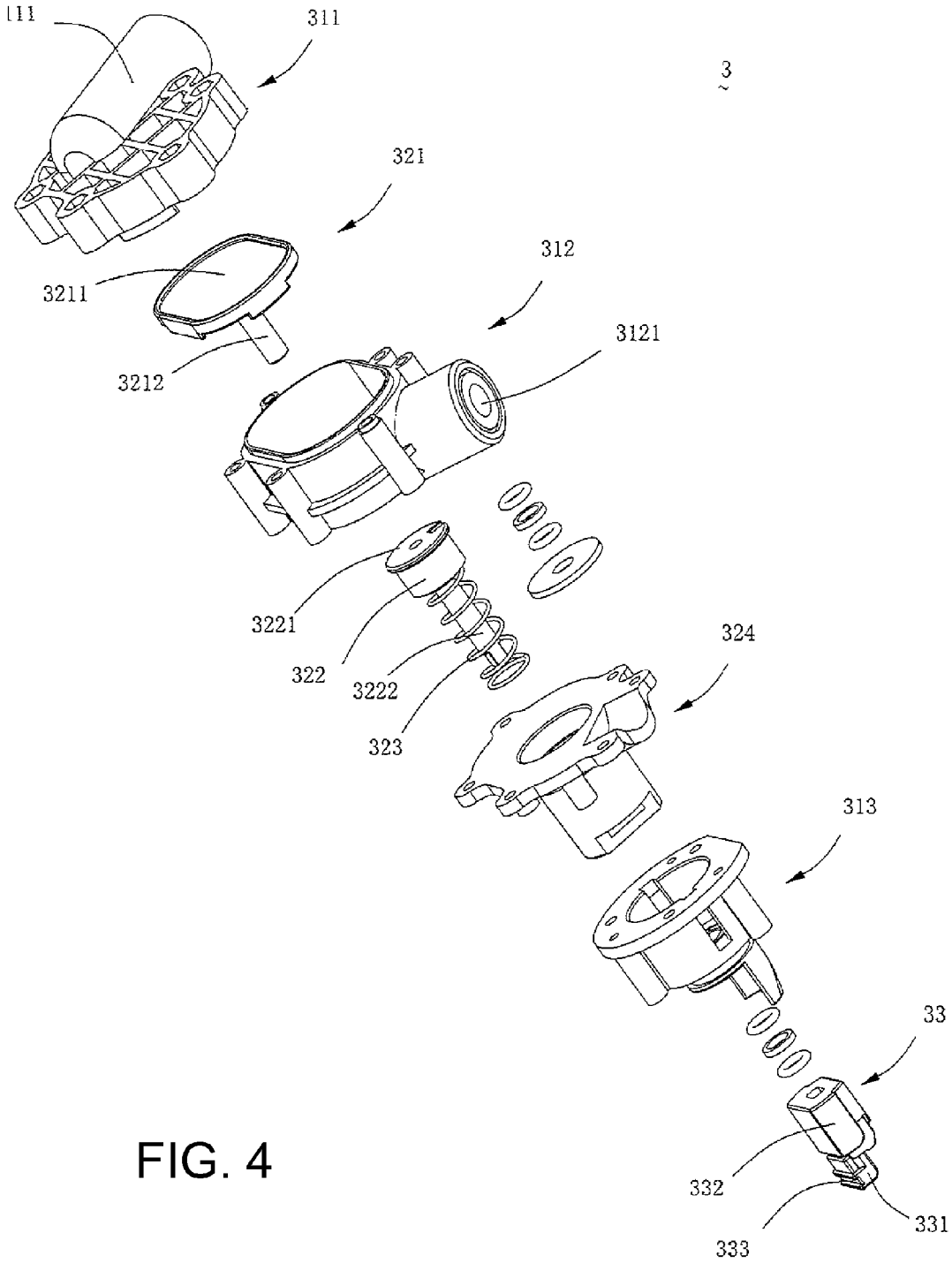
FIG. 4 is the exploded diagram of the self-cleaning device shown on FIG. 3.

Combined with what shown in FIG. 3 and FIG. 4, the conductive sensor 1 of the present invention further comprises a self-cleaning device 3 mounted near the insulating body 11 for cleaning the end of the detecting electrode 12. Said self-cleaning device 3 comprises a housing 31, a piston unit 32 mounted inside the housing 31, and a brush head unit 33 connected with the piston unit 32. Said self-cleaning device 3 also comprises elements for sealing (not marked with numbers), such as seal rings, etc. After mounted, the brush head unit 33 is located inside the sewer pipe 2, and it cleans the end of the detecting electrode 12.

Said housing 31 also comprises a first housing 311, a second housing 312 and third housing 313. A water inlet pipe 3111 connected with tape water pipe is set to the first housing 311 while a water outlet pipe 3121 connected with sewer pipe 2 is set to the housing 312. Said piston unit 32 comprises a first piston 321, a second piston 322, a spring 323 mounted on the second piston 322 and a cylinder body 324 for holding the second piston 322 and the spring 323. Said first piston 321 comprises a first piston top 3211 and a first piston rod 3212.

Said second piston 322 comprises a second piston top 3221 and a second piston rod 3222.

Said first piston 321 is mounted in a holding chamber formed by the first housing 311 and the second housing 312.

After said second piston 322 and said spring 323 held in the cylinder body 324, the cylinder body 324 are mounted in the holding chamber formed by the second housing 312 and the third housing 313.

Said brush head unit 33 comprises a brush head 331 for cleaning the end of the detecting electrode 12 of the conductive sensor 1, and a fixing element 332 for fixing the brush head 331. As shown on FIG. 3, after the self-cleaning device 3 is mounted, the brush head 331 is located near the end of the detecting electrode 12 of the conductive sensor 1. Cleaning strips 333 are set on the brush head 331. In one preferred embodiment of the present invention, said brush head 331 is made of rubber material. In other preferred embodiments of the present invention, the brush head 331 also could be made from other materials that make the brush head 331 clean the detecting electrode 12 easily.

The first housing 311 and the second housing 312 are mounted together. The first piston 321 is held in the holding chamber formed by the first housing 311 and the second housings 312.

Next, the second housing 312 and the third housing 313 are mounted together. After said second piston 322 and said spring 323 held in the cylinder body 324, the cylinder body 324 are mounted in the holding chamber formed by the second housing 312 and the third housing 313. Afterwards, the first piston rod 3212 of the first piston 321 presses at the second piston top 3221 of the second piston 322.

Then, the brush head unit 33 is mounted to the third housing 313. The brush head unit 33 slides to and fro relative to the third housing 313. The end of the second piston rod 3222 of said second piston 322 is connected to the fixing element 332 of the brush head unit 33. Said fixing element 332 is not indispensable. In another embodiment of the present patent, said brush head 331 can be directly fixed to the end of the second piston rod 3222.

When in working, the cleaning valve of water inlet pipe 3111 of the first housing 311 is opened, and then, the tap water flows into the water inlet pipe 3111 of the first housing 311. Thus, the first piston top 3211 of the first piston 321 moves by means of the water pressure. At this time, the first piston rod 3212 presses at the second piston top 3221 of the second piston 322 and drives the second piston 322 to move. Said second piston rod 3222 of the second piston 322 brings the brush head unit 33 to move together. The cleaning strips 333 of said brush head 331 scrapes and cleans the end of the detecting electrode 12 to remove the ordure thereof.

The cleaning valve is closed, and the second piston 322 returns to its original position by means of the elastic force of the spring 323. At this time, the brush head unit 33 follows back to its original position. Then said brush head 331 can clean the end of the detecting electrode 12 of conductive sensor 1 once more. The tap water that acts at the first piston 321 flows into the sewer pipe 2 from the water outlet pipe 3121. The second piston top 3221 of the second piston 322 drives the first piston rod 3212 of the first piston 321 to make the first piston 321 back to its original position.

Thus, the brush head 331 of the self-cleaning device 3 cleans the end of the detecting electrode 12 of conductive sensor 1 back and forth once.

When a user uses the toilet or urinal, urine or other excretion or vomit etc. flows into the trap 23 through the inlet 21 of the sewer pipe 2, which causes change of the electric conductivity of the liquid in trap 23. When the conductive sensor 1 detects the changed signals, it will transfer the changed signals to controller to process, further the controller controls opening of the flush valve, flushing to toilet or urinal, etc. In another embodiment of the present invention, the conductive sensor 1 detects the changed signals, it will transfer the changed signals to controller (not shown on the drawings) to process, further the controller starts detecting sensor mounted in toilet or urinal to work, and then, according to the detected result of the detecting sensor, the controller controls opening of the flush valve, flushing to toilet or urinal, and so on.

The end of the detecting electrode 12 of the conductive sensor 1 in the present invention needs to be immersed in liquid for a long time, and the ordure will accumulates on the end of the detecting electrode 12, which will affects the accuracy of the detecting effect. Therefore, the end of the detecting electrode 12 should be regularly cleaned. Said self-cleaning device 3 is controlled by the controller of toilet or urinal. The controller controls opening and closing of the cleaning valve connected with the self-cleaning device 3, then the self-cleaning device 3 cleans the end of the detecting electrode 12 to avoid decrease or failure of detecting performance of the conductive sensor 1. Thus the detection is more reliable, and the conductive sensor 1 is easy to be maintained.

A urinal having a conductive sensor 1 comprises a urinal body, a sewer pipe 2 for connecting the urinal body with sewage channel, and a controller electrically connected to the conductive sensor 1 for controlling the urinal to flushing. The conductive sensor 1 is mounted to the sewer pipe 2, and located near the trap 23 of the sewer pipe or located at the position of the trap to keep the end of the detecting electrode 12 of the conductive sensor 1 in the liquid in the trap and below the liquid level. The brush head 331 of the self-cleaning device 3 of the conductive sensor 1 is located near the end of the detecting electrode 12, cleaning the end of the detecting electrode 12 regularly.

When the user is using the urinal, the ordure, such as the urine, etc. follow into the trap 23 of the sewer pipe 2, and then the conductive sensor 1 will detect the change of the electric conductivity of the liquid in the trap 23. The controller process the signal for change of the electric conductivity. If the predetermined conditions are satisfied, said controller will controls the opening of the flush valve and flushing to the urinal based on the preset procedure. Or according to the foregoing, said controller starts the detecting sensor mounted at the urinal to work, and then controls opening of the flush valve and flushing to the urinal, etc. based on the detected result of the detecting sensor.

Said self-cleaning device 3 cleans the end of the detecting electrode 12 regularly. The cleaning period is set according to the corresponding application environment (water quality, frequency of using toilet or urinal, etc.), and it is controlled by the controller. The controller controls opening and closing of the cleaning valve connected to the self-cleaning device 3. The self-cleaning device 3 cleans the end of the detecting electrode 12.

In the present invention, the piston unit 32 of said self-cleaning device 3 adopts two units, namely, the piston unit 32 comprises a first piston 321 and second piston 322. The first piston 321 and second piston 322 are separated by the seal element. These arrangements will prevent the liquid in the trap 23 from following into the housing 31 and further regorging to tap water pipe connected to the self-cleaning device 3. In another embodiment of this invention, sealing performance being improved, the piston unit can comprise only a piston and a spring mounted on the piston. The end of piston rod of this piston is connected to the brush head unit. When in working, the cleaning valve is opened, and the piston top of this piston is driven by the water pressure, then the brush head unit is brought to move. When the cleaning valve is closed, the piston backs to its original position by means of elastic force of the spring, and the brush head unit is brought to move. In this embodiment, a water inlet pipe connected with the tap water pipe and a water outlet pipe connected with the sewer pipe are set to the housing holding said piston and said spring, thus the cleaning to the end of the detecting electrode can be realized.

Compared with the prior art, the conductive sensor and the urinal having the conductive sensor of the present invention have cleaning device to clean the detecting electrode, which overcomes the sensing malfunction of traditional conductive sensor caused by the deposited ordure. The water pressure drives the piston and the piston drives the brush head to move to clean the detecting electrode, which brings better result. Therefore, the detected result of conductive sensor and the urinal having conductive sensor are more reliable and the device is easy to be maintained.

It is understandable that the preceding description is given merely by way of illustration and is not the limitation to the present invention and that various modifications may be made without departing from the spirit of the present invention as claimed.

The invention claimed is:

1. An conductive sensor configured to be mounted in the sewer pipe of urinal or toilet, the conductive sensor comprising:

an insulating body;

a detecting electrode mounted at said insulating body to detect the electricity conductivity of the liquid in the sewer pipe;

a self-cleaning device for cleaning the end of the detecting electrode; said self-cleaning device comprises a housing, a piston unit mounted inside said housing, and a brush head unit connected with the piston unit;

a water inlet pipe and a water outlet pipe mounted to said housing, wherein the water inlet pipe is configured to be connected with the tap water pipe and the water outlet pipe is configured to be connected with the sewer pipe, wherein said brush head unit comprises a brush head for cleaning the end of the detecting electrode.

2. A conductive sensor according to claim 1, wherein said housing further comprises a first housing, a second housing and a third housing; said water inlet pipe is set to the first housing and said water outlet pipe is set to the second housing.

3. A conductive sensor according to claim 2, characterized in that said piston unit comprises a first piston, a second piston, a spring set on the second piston, and a cylinder body for accommodating the second piston and the spring;

said first piston comprises a first piston top and a first piston rod, and said second piston comprises a second piston top and a second piston rod.

4. A conductive sensor according to claim 3, wherein said first piston is set inside a holding chamber formed by the first housing and the second housing.

5. A conductive sensor according to claim 4, wherein after said second piston and the spring are accommodated in the cylinder body, the cylinder body is mounted inside the holding chamber formed by the second housing and the third housing; the first piston rod of the first piston presses at the second piston top of the second piston.

6. A conductive sensor according to claim 5, wherein said brush head unit comprises a fixing element used for fixing the brush head; said fixing element is connected with the end of the second piston rod of the second piston.

7. A conductive sensor according to claim 6, wherein cleaning strips are set on said brush head.

8. A conductive sensor according to claim 1, wherein said piston unit comprises the piston and the spring set on the piston; said piston comprises the piston top and the piston rod; the brush head of said brush head unit is fixed to the end of the piston rod.

9. A urinal comprising:

a urinal body;

a sewer pipe configured to connect the urinal body to a sewage channel, said sewer pipe comprising an inlet, an outlet and a trap, said inlet being connected with the urinal body and the outlet being configured to be connected with the sewage channel;

a controller;

a conductive sensor mounted in the sewer pipe and electrically connected with the controller, said conductive sensor comprises an insulating body and a detecting electrode mounted at said insulating body to detect the electric conductivity of the liquid in the trap, said conductive sensor also comprises a self-cleaning device controlled by the controller to clean the end of the detecting electrode; said self-cleaning device comprises a housing, a piston unit mounted inside said housing, and a brush head unit connected with the piston unit;

a water inlet pipe and a water outlet pipe mounted to said housing, wherein the water inlet pipe is configured to be connected with a tap water pipe and the water outlet pipe is configured to be connected with the sewer pipe, wherein said brush head unit comprises a brush head used for cleaning the end of the detecting electrode.

10. A urinal having the conductive sensor according to claim 9, wherein said housing further comprises a first housing, a second housing and a third housing; said water inlet pipe is set to the first housing, and said water outlet pipe is set to the second housing.

11. A urinal having the conductive sensor according to claim 10, wherein said piston unit comprises a first piston, a second piston, a spring mounted on the second piston, and a cylinder body accommodating the second piston and the spring; said first piston comprises the first piston top and the first piston rod, while said second piston comprises the second piston top and the second piston rod.

12. A urinal having the conductive sensor according to claim 11, wherein said first piston is mounted inside the holding chamber formed by the first housing and the second housing.

13. A urinal having the conductive sensor according to claim 12, wherein after said second piston and the spring are accommodated to the cylinder body, the cylinder body is mounted inside the holding chamber formed by the second housing and the third housing; the first piston rod of the first piston presses at the second piston top of the second piston.

14. A urinal having the conductive sensor according to claim 13, wherein said brush head unit comprises a fixing element connected with the end of the second piston rod of the second piston.

15. A urinal having the conductive sensor according to claim 14, wherein cleaning strips are mounted on said brush head.

16. A urinal having the conductive sensor according to claim 9, wherein said piston unit comprises a piston and a spring set on the piston; said piston comprises a piston top and a piston rod; the brush head of said brush head unit is fixed at the end of the piston rod.

* * * * *

UNITED STATES PATENT AND TRADEMARK OFFICE

CERTIFICATE OF CORRECTION

PATENT NO. : 8,713,721 B2
APPLICATION NO. : 12/915526
DATED : May 6, 2014
INVENTOR(S) : Zhang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 760 days.

Signed and Sealed this
Twenty-first Day of July, 2015

Michelle K. Lee

Michelle K. Lee
*Director of the United States Patent and Trademark Office*